United States Patent [19]

Brody

[11] 4,343,217

[45] Aug. 10, 1982

[54] DUAL MODE GUITAR

[76] Inventor: Reid Brody, 5525 W. Warren St., Morton Grove, Ill. 60053

[21] Appl. No.: 242,881

[22] Filed: Mar. 12, 1981

[51] Int. Cl.[3] ..... G10D 1/08; G10G 3/00; G10H 3/18

[52] U.S. Cl. ..... 84/1.16; 84/263; 84/267; 84/327

[58] Field of Search ..... 84/1.16, 170, 173, 263, 84/267, 291, 293, 327

[56] References Cited

U.S. PATENT DOCUMENTS 1,554,806 9/1925 Furia ..... 84/263

3,636,809 1/1972 Ezaki ..... 84/263

*Primary Examiner*—Stanley J. Witkowski

*Attorney, Agent, or Firm*—McWilliams, Mann & Zummer

[57] ABSTRACT

A stringed musical instrument is provided upon which music may be performed in either of two manners. The body of the instrument, which may be electrically amplified, has two complete sets of strings, amplification pickups, volume and tone controls and necks which radiate in substantially opposite directions. The instrument is suspended from a harness worn by the performer by means of a mechanical and electrical rotary connections. The instrument may be rotated by the performer on a horizontal axis to bring the instrument into the desired playing position.

5 Claims, 6 Drawing Figures

DUAL MODE GUITAR

SUMMARY OF THE INVENTION

This invention relates to new and useful improvements in a stringed musical instrument particularly of the electrically amplified guitar variety. There are many types of electric guitars currently in use. Among these are bass, six-string and twelve-string. In some circumstances of performing, it may be desirable for one performer to play two such different types of guitars to give different tonal qualities, for example, to different musical passages. Prior to the present invention, this could be accomplished by the cumbersome procedure of removing one guitar from the performer and picking up the second desired guitar. The present invention greatly simplifies this procedure by enabling the performer to play an instrument embodying two distinctly different types of guitar so that he may change rapidly from one to the other and back again. This is accomplished by utilizing two separate necks, two separate sets of strings, two separate electrical pickups and two separate sets of amplification controls. The necks of the instrument are disposed in substantially opposite directions, one set substantially parallel to the other so that they are substantially equally spaced from the center of the face of the guitar.

The instrument is suspended from a harness worn by the performer by means of a mechanical and electrical rotary connection. When the performer wishes to change the mode of performing he simply rotates the guitar 180 degrees through a vertical plane.

In the prior art, dual mode stringed instruments have been illustrated, but these do not embody the features and advantages of the present invention. U.S. Pat. No. 1,554,806 to Furia illustrates a combination of a banjo and a mandolin with a common body but with the necks attached to opposite faces thereof, and radiating from the body at an acute angle relative to each other. The instrument is held on the performer's lap. U.S. Pat. No. 3,636,809 to Ezaki illustrates a guitar with two necks attached to opposite sides of the guitar body. Both necks extend in the same direction from the body. Dual mode guitars of the 6- and 12-string variety are currently available with both necks radiating in the same direction from the body parallel to each other. The present invention, however, is better balanced and more attractive in appearance and presents the additional benefits of showmanship and audience appeal when spun by the performer.

DESCRIPTION OF THE PREFERRED EMBODIMENT

Figure 1:
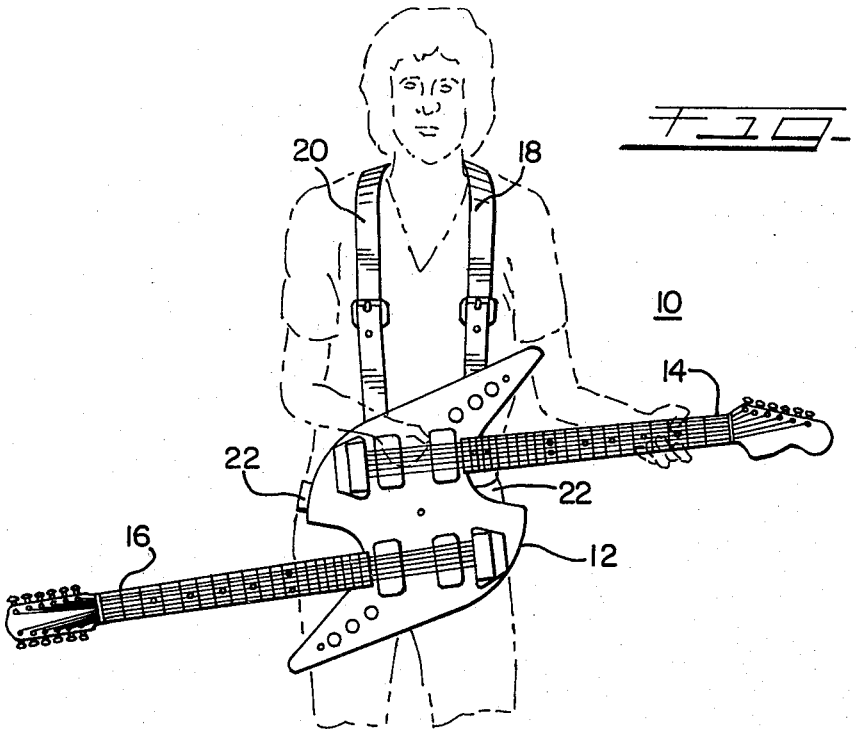
FIG. 1 is a front elevation of the invention as held by the performer as shown in phantom.

Turning now to the drawings, there is shown in FIG. 1 a front view of the present invention 10 being held and played by the performer (shown in phantom) in the six-string mode. Body 12 is located at the center of the instrument and acts as a base to which the other components are attached. Necks 14 and 16 radiate outwardly from body 12 in substantially opposite directions. The two necks 14 and 16 are substantially equally offset from the instrument's center of rotation, thus the necks are substantially parallel to each other and may be described as being non-colinear. In this embodiment, neck 14 carries six strings and neck 16 carries twelve strings. It should be noted that other choices regarding the number of strings can be made by those skilled in the art. The instrument is carried by the performer on a rotary connection (described below) which is attached to an adjustable harness comprising shoulder straps 18 and 20 and waist strap 22.

Figure 2:
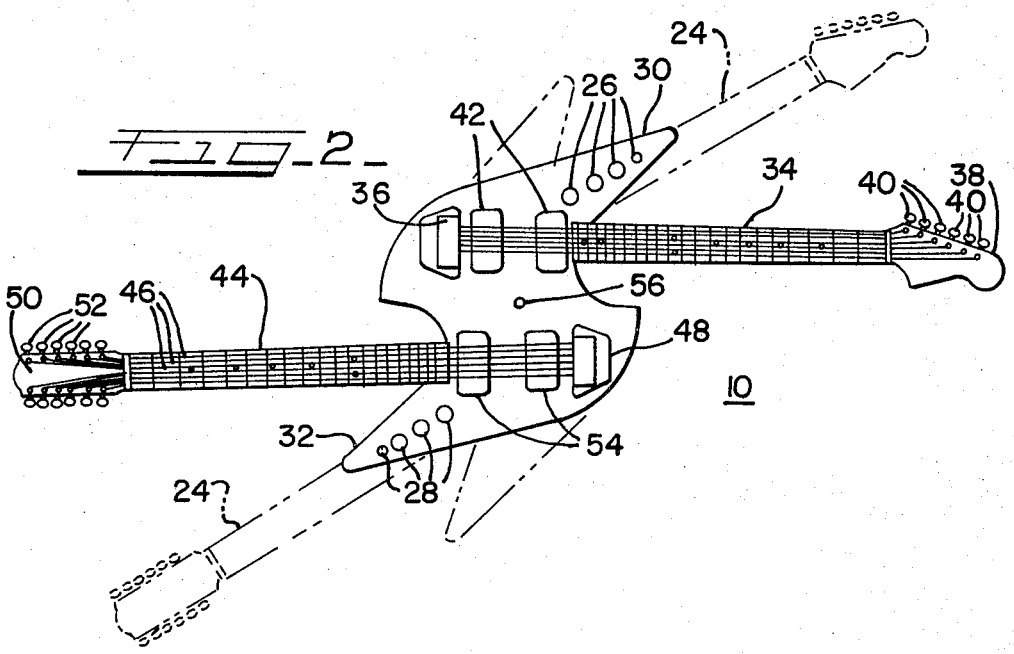
FIG. 2 is a front elevation of the guitar with an intermediate rotational position shown in phantom.

FIG. 2 illustrates instrument 10 in a front elevational view with an intermediate rotational position of the instrument shown in phantom at 24. The components of the instrument visible from this view include the amplification controls 26 and 28 located on body extensions 30 and 32, respectively. In this embodiment, six-string neck 34 carries strings which extend from bridge 36 to tuning head 38. The tension of the strings may be adjusted by turning tuning knobs 40. Musical signals are carried by pickups 42 to the electrical amplification system (shown schematically and designated by reference character 91). Twelve-string neck 44 carries strings 46 from head 48 to tuning head 50 where tension on these strings may be adjusted by means of tuning knobs 52. Acoustical pickups 54 convert acoustical signals to electrical signals and carry them to the amplification system. Switch 56 enables the performer to activate either or both sets of pickups.

Figure 3:
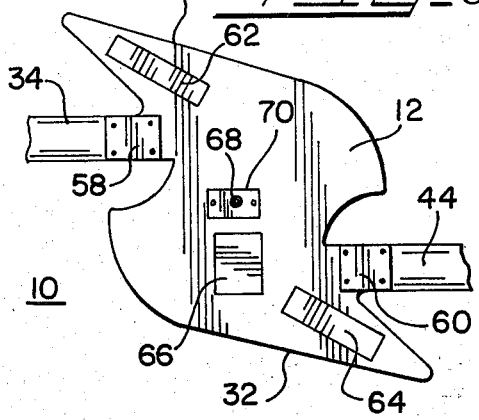
FIG. 3 is a partial rear elevational view of the invention.

FIG. 3 shows a rear view of the instrument 10. Necks 34 and 44 are shown attached to body 12 and reinforced by reinforcement plates 58 and 60, respectively. Cover plates 62, 64 and 66 conceal electrical components. Amplification jack 68 is located at a point near the instrument's center of gravity and is mounted on plate 70.

Figure 4:
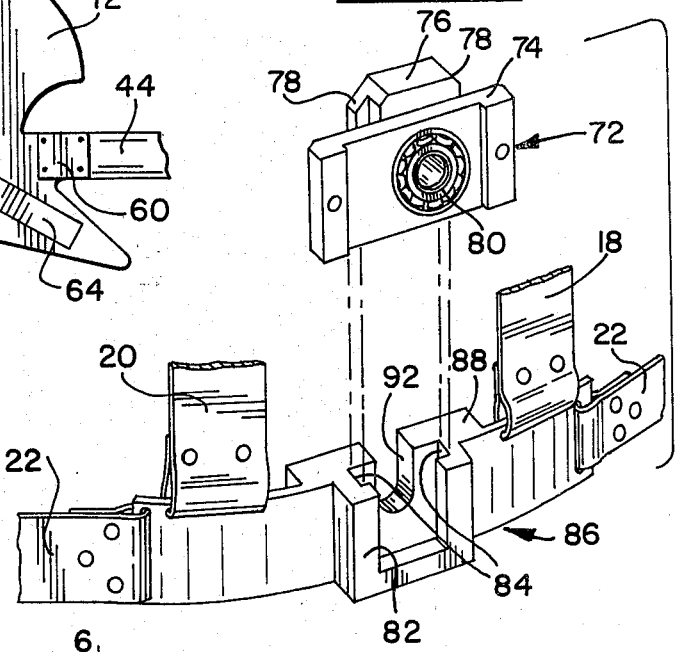
FIG. 4 is an exploded view of the mechanical rotary connection showing the straps of the harness partially broken away.

FIG. 4 illustrates the components of the mechanical rotary connection in exploded view. Bearing assembly 72 consists of forward flange 74 and rear flange 76 connected by bearing member 80. Rear flange 76 mates to socket 82 by means of a slip fit with ridges 78 adjacent to groove 84. Socket 82 is located at the center of mounting assembly 86 which is in turn supported by shoulder straps 18 and 20 and by waist strap 22. Mounting assembly 86 includes rear projection 88 to keep the mounting assembly 86 some distance from the performer's body.

Figure 5:
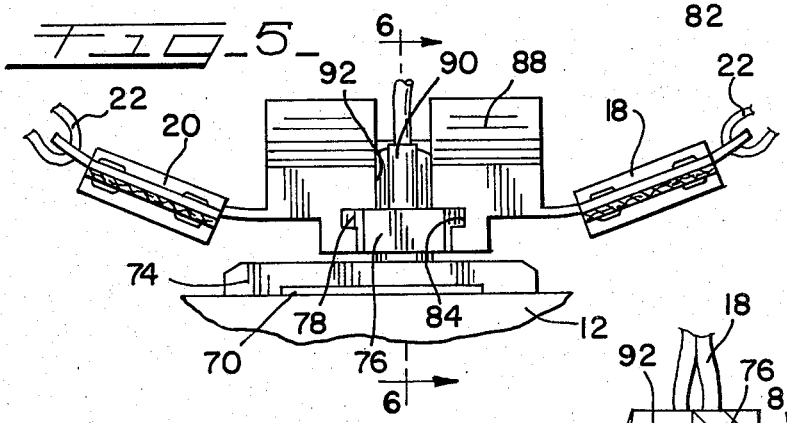
FIG. 5 is a top elevation of the mechanical and electrical rotary connection attached to the rear of the instrument.

FIG. 5 shows a top view of the rotary connection with front flange 72 fixedly attached to body 12 at plate 70 with amplification plug 90 inserted into amplification jack 68 passing through slot 92 and concentric with bearing member 80.

Figure 6:
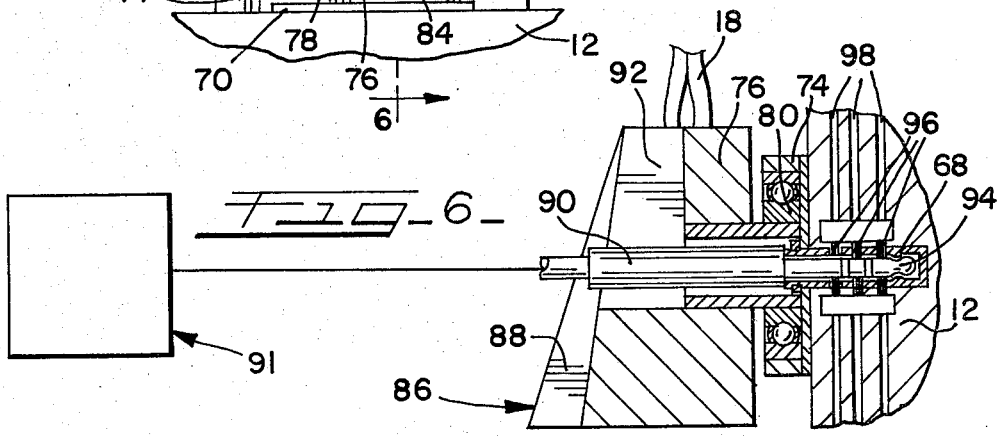
FIG. 6 is a cross-sectional view of the mechanical and electrical connection taken across line 6—6 of FIG. 5.

FIG. 6 illustrates, in cross-sectional view, the electrical rotary connection with plug 90 inserted into jack 68 so that triple contact 94 may rotate in contact with electrically conductive brushes 96 which are attached to leads 98.

What is claimed is:

1. A stringed musical instrument of the guitar type comprising a body portion, a first neck secured to and radiating outwardly from said body portion, a second neck secured to and radiating from said body portion in a direction substantially opposite but non-colinear to said first neck, each of said necks adapted to carry strings under tension, a mechanical rotary connection attached to the rear of said body proximate to the center of gravity of said body and adapted to be attached to a harness adapted to be worn by a performer.

2. A stringed musical instrument as in claim 1 further comprising means for electrically amplifying acoustical signals from said strings.

3. A stringed musical instrument as in claim 2 further comprising a rotary electrical connection disposed concentrically with said mechanical rotary connection and adapted to transmit electrical signals from said stringed musical instrument to an electrically powered amplification system.

4. A stringed musical instrument as in claim 3 further comprising switching means adapted to conduct electrical impulses from either or both of two audio-electrical transducers associated with each of said necks respectively, to said electrically powered amplification system.

5. A stringed musical instrument as in claim 1 wherein said rotary connection means comprises a first flange fixedly attached to the rear of said body, a second flange adapted to be inserted into a receptacle worn by said performer on said harness, said first and second flanges rotatably connected by a ball bearing assembly.

* * * * *